US006616293B2

(12) United States Patent
Mickey

(10) Patent No.: US 6,616,293 B2
(45) Date of Patent: Sep. 9, 2003

(54) LIGHTED HAT DEVICES WITH ROTATABLE SWITCH FEATURE

(76) Inventor: Scott Alan Mickey, 7358 Riverside Pl., Orlando, FL (US) 32810

( * ) Notice: Subject to any disclaimer, the term of this patent is extended or adjusted under 35 U.S.C. 154(b) by 0 days.

(21) Appl. No.: 09/843,595

(22) Filed: Apr. 26, 2001

(65) Prior Publication Data

US 2002/0159249 A1 Oct. 31, 2002

(51) Int. Cl.[7] ..... F21L 15/14

(52) U.S. Cl. ..... 362/106; 362/287; 362/427; 362/105

(58) Field of Search ..... 362/105, 106, 362/287, 427

(56) References Cited

U.S. PATENT DOCUMENTS 4,092,704 A * 5/1978 Malm ..... 362/106
4,991,068 A * 2/1991 Mickey ..... 362/288
5,359,501 A * 10/1994 Stevens ..... 362/108
5,541,816 A * 7/1996 Miserendino ..... 362/106
5,558,429 A * 9/1996 Cain ..... 362/276
5,676,449 A * 10/1997 Newsome ..... 362/105

* cited by examiner

*Primary Examiner*—Thomas M. Sember
(74) *Attorney, Agent, or Firm*—Joseph Fischer; Van Dyke & Associates, P.A.

(57) ABSTRACT

A lighted cap is described, comprising a cap having a crown and a bill, and a light structure rotatably fixed to a point on the bill. Rotation to a forward-facing direction for the light results in contacting a contact point that closes a circuit, thereby supplying power to the lamp in the rotatable light structure. The light is used for nighttime activities, such as fishing, when light is needed and a light-weight hat is desired.

13 Claims, 5 Drawing Sheets

LIGHTED HAT DEVICES WITH ROTATABLE SWITCH FEATURE

FIELD OF THE INVENTION

The present invention relates to head mounted lamp devices and, more particularly, to an improved lighted hat combination, whereby a part of a mounted lamp structure reversibly rotates to turn the lamp on and off.

BACKGROUND OF THE INVENTION

Lamps have been mounted to headgear for many years. Most well known, perhaps, is the old style carbide lamp mounted on miners' hard hats. More recently, carbide lamps have been replaced by battery-powered lamps. When such lamps have been mounted on hard hats, little concern has been expressed for the mounting technique since hard hats provide adequate support. Other lamps are known that are strapped to a user's head with elastic straps, wherein a forward-facing lamp housing provides the user with light. However, there are other applications for head mounted lamps in which it is desirable to reduce the weight of the lamp and to provide relatively stable mounting. For example, night fishermen commonly wear lightweight baseball style caps either formed entirely of cloth or with a cloth bill or brim and a plastic mesh crown. Most prior art lamps would either not be supportable on such caps or would be too uncomfortable for long use.

One attempt to solve the problem of weight for such head mounted lamps has been to mount the batteries for a lamp separately from the lamp, such as on a waist belt, and to connect the cap by long wire. Another alternative is to mount a single cell powered incandescent bulb and battery on the brim of a cap, which alternative may be sufficient when relatively little light is desired. In general, none of the prior art devices have provided satisfactory arrangements of high intensity lighting with integral batteries and multi-positional lamps.

One patent, U.S. Pat. No. 4,991,068, also invented by the present inventor, attempted to solve these problems with a combination of a baseball-style cap and a lighting system that, in its preferred embodiment, included two battery packs, one on each side of the cap, a hermetically sealed push-button switch positioned near one edge of a bill of the cap, connecting wires, and a lamp supported by a lamp support. The lamp support was permanently fixed in the forward direction, and at one end provided a means to adjust the up and down direction of the light from the lamp. The lamp support had a very specific means of connection to the lamp, and for the adjustment of lamp angle in a single plane.

The present invention solve problems in the art of lighted hats, and advances the art with a combination that includes a novel arrangement of components on the bill of a hat to create a knife-like electrical switch that improves the ease of operation of a lighted cap, and avoids the need for a separate, hermetically sealed switch.

SUMMARY OF THE INVENTION

It is an object of the present invention to provide a combination hat and lamp which overcomes the above and other disadvantages of the prior art. Specifically, it is an object of the present invention to provide a more convenient means to turn a lamp on and off when the lamp is positioned on a bill of a cap worn on a user's head. It is also an object of the present invention to provide improved and flexible means to support a lamp positioned on a bill of such a cap, and to generally provide a hat having a light where the power to the light is turned on by rotating a lamp structure affixed to a single point on the hat.

It is also an object of the present invention to facilitate the near-simultaneous turning on of, and adjusting the angle of, a lamp affixed to a hat. This is important to sportspersons, such as fishermen, during nighttime use. Compared to other devices in the art, the present invention avoids the need to press a switch in one location, and then move one's hand to a different location, to the lamp itself, to adjust the lamp angle as needed.

It is another object of the present invention to provide a mounting arrangement for a high intensity lamp that permits control of light direction and integral battery storage.

In one embodiment, a combination hat and lamp is provided with the hat having a crown, a bill extending from the crown, a liner circumscribing at least a portion of an edge of the crown, and an adjustable strap operatively associated with the crown for adjusting the hat to various different head sizes. The liner comprises a strip of material having an upper edge, a lower edge, and first and second ends. The lower edge is securely fastened to a bottom edge of the crown with the upper edge laying against an inner surface of the crown, while the first and second ends are attached to respective ends of the adjustable strap. Integral in this combination is a bill having on its top surface, in a line generally going from the rear forward, a first member mounted on the bill, from which rotates a support structure bearing at its forward end a lamp, and bearing a point of connection at an intermediate location, contacting upon rotation, a second member mounted forward on the bill. When the point of connection and the second member are in contact, an electrical circuit is closed, and the light has power to turn on. This knife-like switch design obviates the need for a push-button or other type of conventional switch, and facilitates operation of the switch during night-time uses.

In a preferred embodiment, first and second battery holders are located respectively on opposite sides of the crown of the hat between the crown and the liner. A first wire extends from the first battery holder to connect to the first member on the bill. A second wire extends from the second battery holder to a first electrical terminal of the lamp, and a third wire travels from the other lamp electrical terminal to the second member on the bill. A fourth wire connects the remaining ends of the battery packs together. Thereby, moving the support structure from a side to a forward position, upon contact of the point of connection with the second member, a circuit is closed and the lamp receives power from the batteries. The point of connection is electrically conductive and passes electricity between the first and second members in order to close the circuit.

Other embodiments provide a semi-rigid, adjustable conduit as a portion of the support structure, that may provide a flexible, more adjustable support as an alternative to the support structure described in a preferred embodiment. This allows adjustment of the light beam to a point other than in a single plane defined by the positioning of the lamp housing on the support structure.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
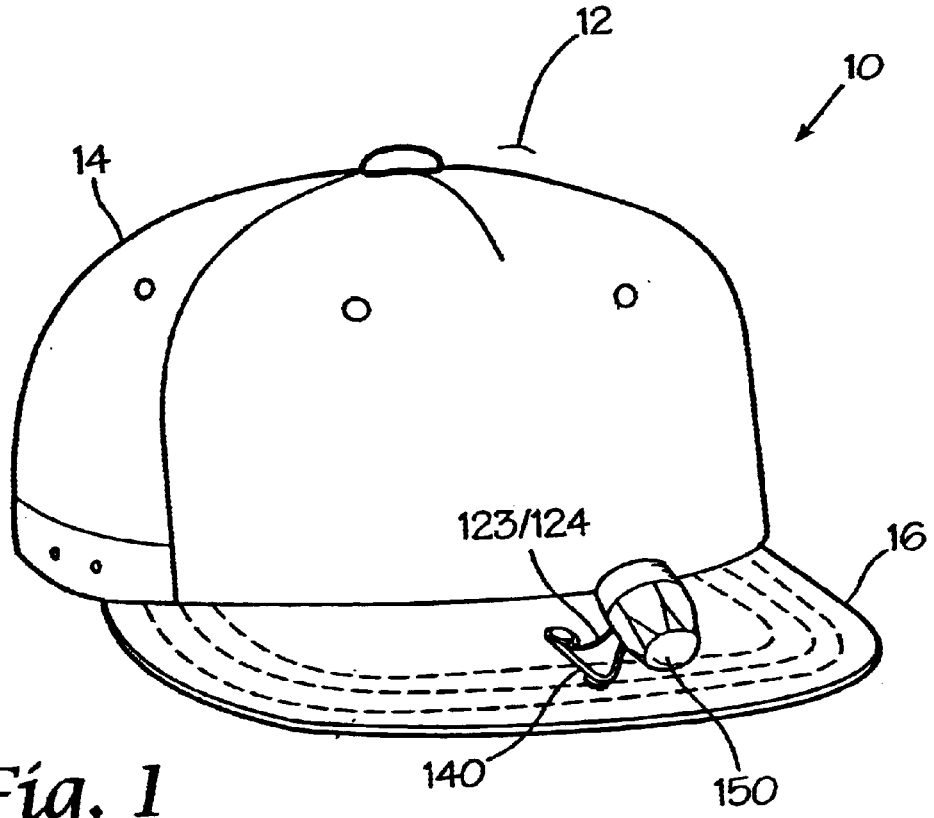
FIG. 1 is a front perspective view of a lamp and cap combination in accordance with the present invention.
Figure 2:
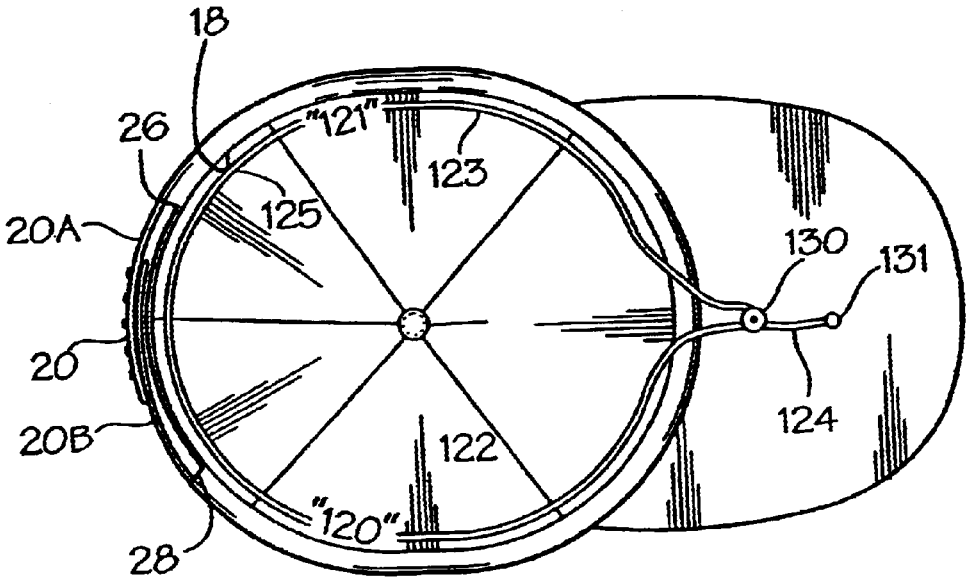
FIG. 2 is a bottom view of the cap and lamp of FIG. 1.
Figure 3:
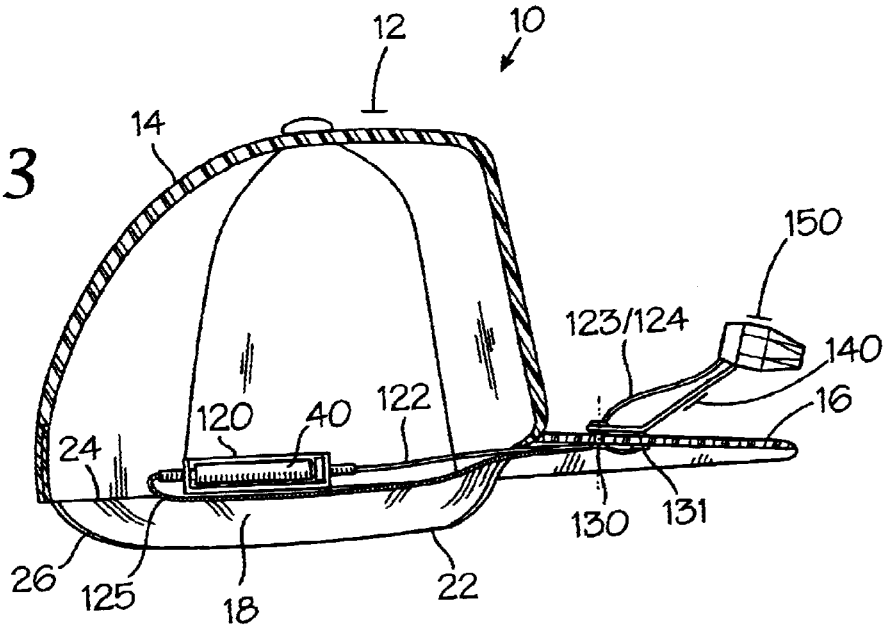
FIG. 3 is a cross-sectional view taken through the cap of FIG. 1 showing the battery mounting arrangement.

Referring generally to FIGS. 1, 2, and 3 there is shown a preferred embodiment of a combination lighted hat 10 comprising a baseball style cap or hat 12 having a crown 14, a brim or bill 16, a liner 18 circumscribing at least a portion of the lower edge of the crown 14 and a strap 20 comprising two adjustably connectable sections 20A and 20B which may be fastened together to fit the crown of the hat to various different head sizes. The liner, best seen as folded out in FIGS. 2 and 3, comprises a strip of material having an upper edge 22, a lower edge 24, and first and second ends 26 and 28. The lower edge 24 of the liner 18 is fastened to the crown 14 generally by sewing the edges of the crown and liner together. The upper edge 22 is folded upward during normal use so that it lies against an inner surface of the crown.

The lamp system attached to the hat, 10, comprises first and second battery holders, 120 and 121 (not shown), respectively, located on opposite sides of the crown of the hat between the crown and the liner. A first wire, 122, extends from the first battery holder, 120, to connect to the first member, 130, on the bill, 116. A second wire, 123, extends from the second battery holder, 121, to contact a first electrical terminal of the lamp (not shown), and a third wire, 124, travels from the second lamp electrical terminal of the lamp (not shown) to the second member, 131, on the bill. A fourth wire, 125, connects the remaining ends of the battery packs together. Much of this wiring is shown diagrammatically in FIG.2, with the battery holders indicated as "120" and "121".

A support structure, 140, is mounted onto and rotates from the first member, 130. In a preferred embodiment, the support structure is a rigid, electrically conductive wire extending linearly from the first member, 130, and inflecting upward to give height to the lamp housing, 150, which is positioned at or near one end of the support structure, 140. The support structure, 140, includes a point of connection, 142, which is a set distance from the first member, 130, so as to contact a second member, 131, when the support structure, 140, is rotated to a forward-aligned position.

When the point of connection, 142, and the second member, 131, are in contact, an electrical circuit is closed, and the lamp is provided with power, via the first and second electrical terminals, to light a bulb, 151, in the lamp housing. The point of connection is electrically conductive and passes electricity between the first and second members in order to close the circuit. It is noted that lamp, light bulb, and bulb may be used interchangeably in this specification.

As best seen in FIG. 3, in a preferred embodiment a battery holder, 120, is attached to the crown 14 adjacent a lower edge thereof and is normally located between the liner 18 and the crown 14. The battery holder, 120, is preferably a AAA size battery holder for containing a single AAA cell, 40. Any standard fastening means may be used to affix the battery holder to fabric of the crown, 14. The present inventor has found that by using a single cell battery holder on each side of the cap mounted between the liner and the cap crown, the padding normally found in the perspiration absorbing liner is usually sufficient to protect the wearer's head and to avoid any sensation of pressure from the individual battery holders. However, depending on the power requirements of a particular lamp, for instance and LED requiring a higher voltage, and the operating time desired for a set of batteries, any number of batteries may be used, in series or in parallel, to provide the necessary voltage and operating time. These batteries would be housed in suitable battery holders.

Figure 7:
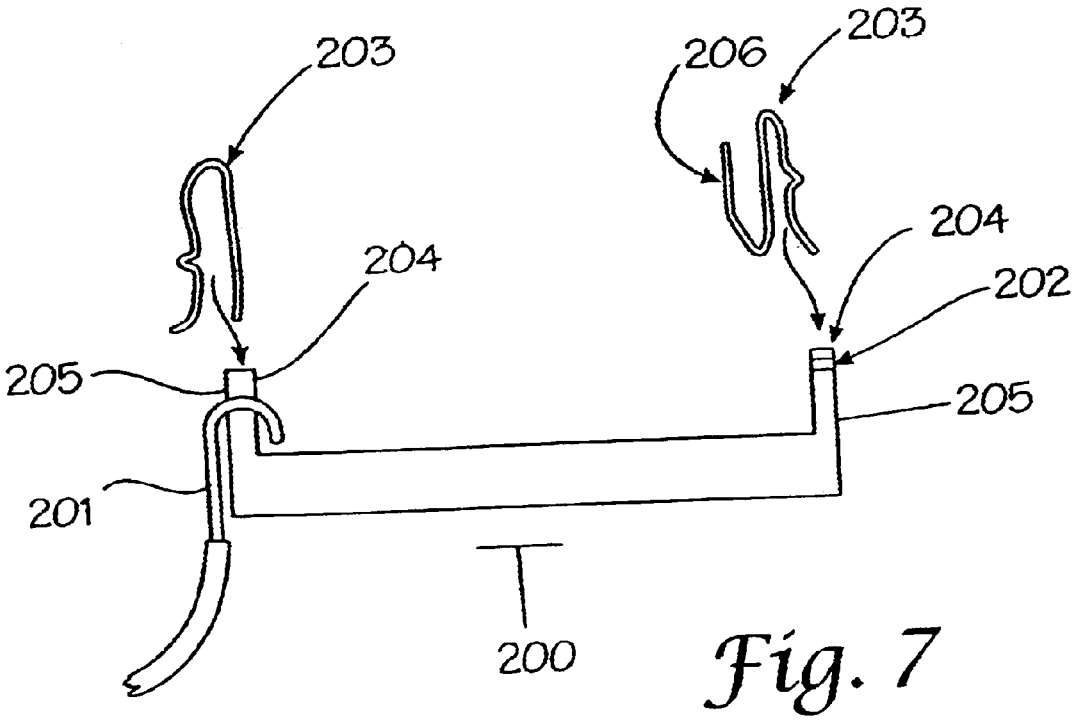
FIG. 7 is a cross-section partially disassembled view of a preferred embodiment of a battery holder.

A preferred embodiment of the battery holder is shown in FIG. 7. To assemble the battery holder, 200 to the wires, for each end a bare wire end, 201, is placed into a hole 202, of the holder, 200. Then a clip, 203, is pressed over the open, or top, side, 204 of the end wall, 205, pressing the bare wire and making pressure contact sufficient for electrical conduction, while also making a tight fit over the end wall, 205, to position the inside of the clip, 203, to contact a battery (not shown). The clip extends across most of the width of the battery holder end wall, 205. One or both clips are formed to provide a plate, 206, that springs away upon insertion of a battery, such that the battery is under sufficient compression between holders at opposite ends so as to remain firmly in place. This is shown in FIG. 7 as 203V. This embodiment has proven to lessen assembly time and to perform well in the present invention.

Figure 4:
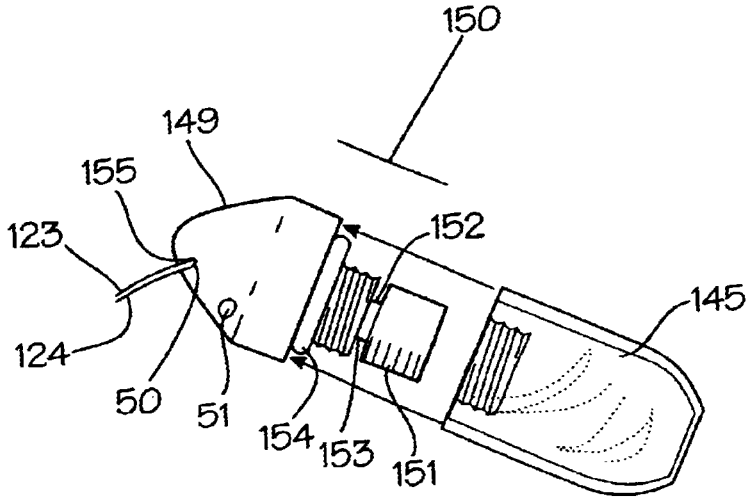
FIG. 4 is a partially-exploded view of the lamp housing mounted on the cap in FIG. 1.
Figure 4A:
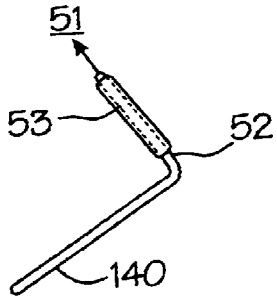

The lamp housing, 150, houses a lamp, or light bulb, that receives power from the batteries when the circuit is closed. Preferably, a high intensity lamp of a type commercially available is used. However, any light-generating source, such as an LED, or other light sources as known in the art, may be used for the 'lamp,' 'lamp bulb,' or 'light bulb' in the present invention. FIG. 4 is a partially exposed view of this type of replaceable high intensity light bulb, 151, in a lamp housing, 150. In particular, within the screwed-on clear front cover, 145, is the lamp bulb itself, 151. The first and second electrical terminals, 152 and 153, respectively, of the light bulb, make contact with the second and third wires, 123 and 124, respectively, that extend into the lamp housing, 150. A seal, 154, such as a rubber O-ring, is at the base of the threads of the rear section, 149, of the lamp housing, 150. This serves to help seal the lamp bulb, 151, and the electrical connections from moisture or other contaminants. Also, a water-impermeable sealant, 155, fills the void around the second and third wires, 123 and 124, respectively, going to the lamp bulb, 151, as they pass through an aperture, 50, passing through the lamp housing, 150.

In a preferred embodiment, the rear section, 149, has a hole, 51, transverse to the rear/forward axis of the lamp housing, 150. This hole, 51, receives an end, 52, of a support structure, 140. A section of flexible tubing, 53, covers the end, 52, while still permitting entry into the hole, 51. During manufacture, pressure is applied at a point of the rear section, 149, overlying the tubing, 53, to stake, or crimp, said tubing into a fixed position in the hole, 51, between the walls of the 10 hole and the end, 52, of the support structure that is positioned within the tubing, 53. So positioned, the flexible tubing, 53, makes a tight fit that nonetheless allows the user to adjust the angle of the housing, 150, as needed to direct the beam from the lamp bulb, 151, to a desired position.

In a preferred embodiment, the lamp holder 151 is supported above the bill 16 on the support structure, 140, as described herein. The support structure, 140, has a first end, 141, that surrounds the post, 143, of the first member, 130. For instance, the first end, 141, in FIG. 5, wraps around the post, 143, and is also held rigidly in place between a bottom plate, 144, and a top plate, 145, of the first member, 130. So positioned, the first end, 141, serves as a pivot point around which the remainder of the support structure, 140, is rotated, as by moving with pressure from the wearer's fingers. Contiguous with the first end, 141, is a span, 146, of the support structure, 140, that extends a distance equal to the distance between the first and second members, 130 and 131, respectively. Around this distance is the point of connection, 142, which, upon contacting the second member, 131, completes an electrical circuit. In a preferred embodiment, the point of connection, 142, is merely that section of the rigid wire of the support structure, 140, that contacts the second member, 131. However, in other embodiments, such as when the support structure, 140, is made of non-electrically conducting material, the point of connection, 142, would be positioned onto the support structure, 140, but would be an exposed section of conductive material in a circuit that is independent of the non-conducting support structure.

Figure 5:
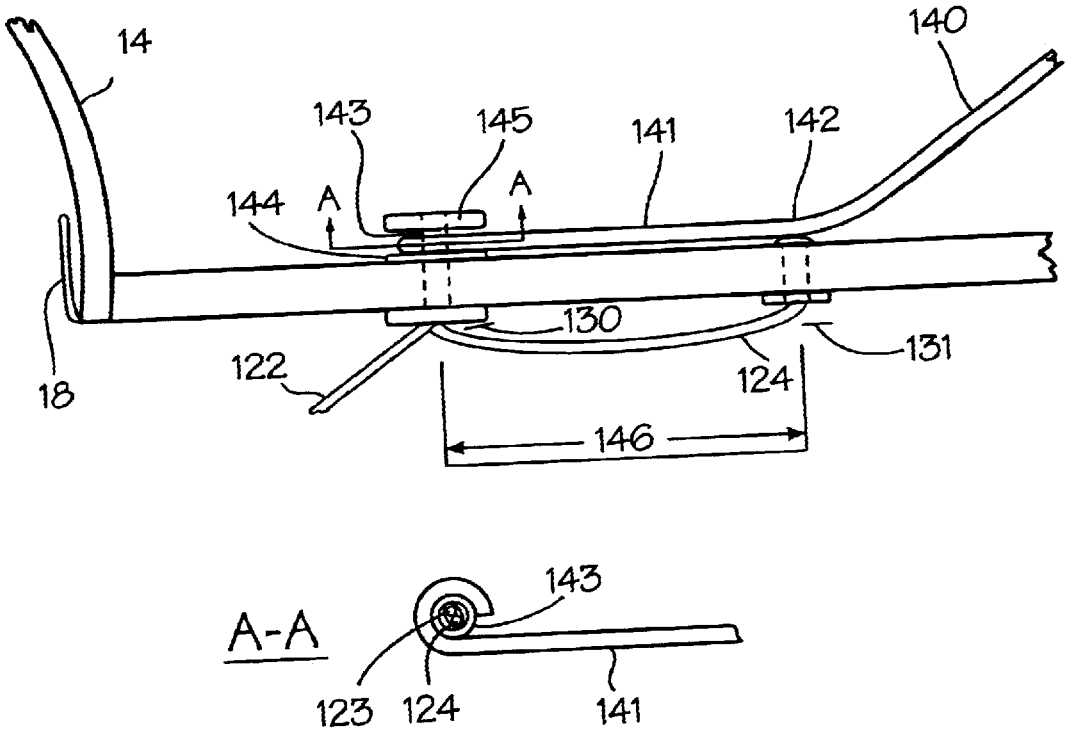
FIG. 5 is a cross-sectional view of the pivotable connecting means for mounting the lamp support on the cap of FIG. 4, with wiring connections indicated by arrows.

The support structure, 140, extends beyond the span, 146, a desired distance, and then, as shown in FIG. 5, inflects at a 90 degree angle to form the end, 52, that inserts into the hole, 51, of the rear section, 149, of the lamp housing, 150. As noted, the tubing, 53, is positioned between the end, 52, and the body of the rear section, 149, of the lamp housing, 150. The design of the key components of the support structure, 140, can be modified to suit function and aesthetics, and are still within the scope of the present invention. Illustrative, not limiting, examples are provided in FIG. 6.

Figure 6A:
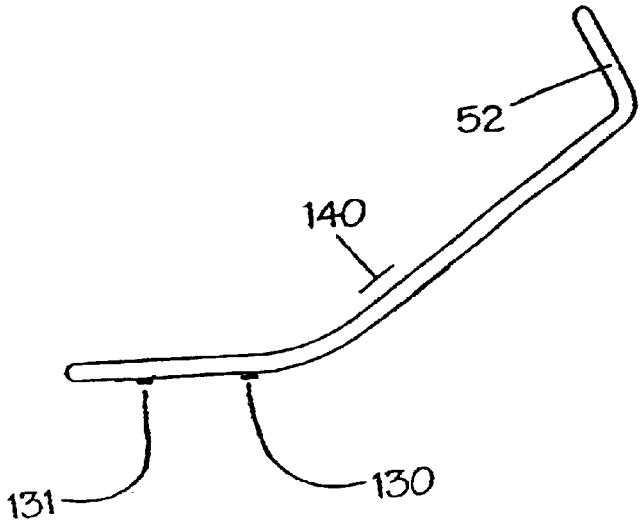
FIG. 6 provides side views of alternative designs of support structures.
Figure 6B:
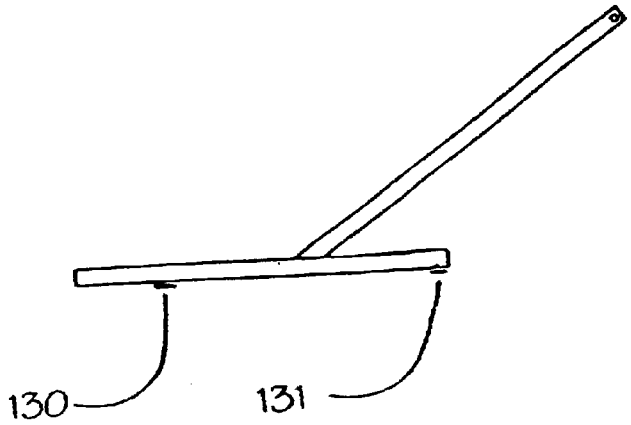

Further, while in the above embodiment the support structure, 140, is preferably comprised of stainless steel that is electrically conductive, other compositions of a support structure are possible. For instance, a molded rigid hard plastic support structure may be used for components of the support structure, 140. Designs of such support structure, as shown in FIG. 6, can be made, partly or entirely, of such plastic. Since plastic is not electrically conductive, the support structure includes a conductive wire or conduit leading to the point of connection, in order to complete the electrical circuit when the support structure is rotated into position above the second member positioned on the bill. Also, in FIG. 6A, the end, 52, is stainless steel. In certain instances, a flexible section of the support structure (analogous to a gooseneck lamp structure) may be desired to allow the user to direct the light beam to a point not directly forward. This, preferably, would be distinct from the rigid area between the first and second members, 130 and 131, respectively, and such flexible structure may be accomplished by means known to those skilled in the art.

Also, the second member need not be positioned directly in front of the first member. The second member may be positioned to one side, or behind, the first member. Obviously, the shape of the support structure, and the relative position of the point of connection, would change in such different special configurations.

It will be appreciated that what has been described is a lightweight high intensity lamp arrangement for use with a cloth or similar material type of baseball cap which can be worn in relative comfort. The miniature lamp, as described above, is relatively small and is preferably an O-ring sealed high intensity lamp having a weight of less than one-half ounce. One type used is a xenon type lamp; however, the lamp bulb can be of any other type, such as with krypton gas, or an LED, that is found to be suited for the particular application. The battery holders are miniature holders each designed to hold a single AAA size battery cell. In a preferred embodiment, the lamp holder is mounted on a stainless steel support structure that is relatively stiff and which is mounted at a single point on the bill, and which rotates around this point, whereby the lamp is powered when a second point is contacted by the support structure, closing the electrical circuit. The lamp housing itself can be tilted at various different angular positions in a vertical plane and will retain the angular position due to the friction between the tubing and the end of the support structure.

It will also be appreciated that the lighted hat device of the present invention may be used on hats other than baseball-style caps having a bill. The critical features of the present invention can be applied to any hat having a sufficiently large and rigid area on which is mounted the rotating switching means. It is noted that for the embodiments described herein, and for other embodiments covered by the claims presented, there is an additional aesthetic advantage of being able to rotate the lamp, when not in use, off to one side.

In other embodiments, a portion of the support structure can be made of flexible material, and may optionally also contain the wiring traveling to the lamp housing. This would allow movement of the lamp to direct light in planes other than the basic plane of the embodiment described above. There still is a need to have a portion of the support structure extend to the second member, and to provide a point of connection, in order to close the electrical circuit. This portion may be of a conductible metal, plastic having a wire and electrical contact as the point of connection, or other means known to those skilled in the art. Additionally, the section of the support structure between the first and second members need not be parallel to the bill of the hat. Rather, a curvilinear span may be used, such as could be a point of contact by the user to rotate the support structure to turn the lamp on and off.

Having generally described this invention, including the best mode thereof, those skilled in the art will appreciate that the present invention contemplates the embodiments of this invention as defined in the following claims, and equivalents thereof. However, those skilled in the art will appreciate that the scope of this invention should be measured by the claims appended hereto, and not merely by the specific embodiments exemplified herein. Those skilled in the art will also appreciate that more sophisticated technological advances will likely appear subsequent to the filing of this document with the Patent Office. To the extent that these later developed improvements embody the operative principles at the heart of the present disclosure, those improvements are likewise considered to come within the ambit of the following claims.

What is claimed is:

1. A hat with a lamp rotatably attached, comprising:

a. the hat having a crown to cover the head of a user, and a rigid bill extending from one side of the crown;

b. a lamp system comprising:

i. a power source situated in or near said crown or bill;

ii. a lamp in a water-impermeable lamp housing;

iii. a switching device comprising a first member fixed on the bill, a second member fixed on the bill, and a support structure suspending said housing above the bill and affixed to and rotatable about the first member, said structure additionally comprising a contact point that, upon contact with the second member, completes a circuit to provide electricity to said light bulb; and, iv. wiring connected to said power source, light bulb, and switching device arranged to complete an electrical circuit upon contact of said contact point with said second member;

whereby rotation of said support structure operates as a switch to turn power on and off to said lamp.

2. The device according to claim 1, wherein said lamp is a high intensity lamp.

3. The device according to claim 1, wherein the first member and the second member are aligned along a midline of the bill, and the lamp is directed away from the crown.

4. The device according to claim 3, wherein the second member is positioned further from the crown than the first member.

5. The device according to claim 1, wherein the span of support structure between the first member and the contact point is curvilinear.

6. The device according to claim 1, wherein the power source comprises battery holders mounted between the crown and liner of the hat.

7. The device according to claim 6, wherein said battery holders are sized to hold a single AAA size battery.

8. The device according to claim 6, wherein spring clips at both ends of the battery holder press wires to provide electrical contact, press onto the battery holder ends, and provide contacts for a battery placed in the battery holder.

9. The device according to claim 1, wherein a portion of said support structure comprises a flexible material capable of maintaining a desired configuration, such that a user of said device can direct light from the lamp to a desired point.

10. The lighted hat according to claim 6, whereby said lamp structure additionally comprises an extension that distances the first point from the lamp.

11. A lighted hat, comprising the hat including a crown and a bill, and a lamp structure rotatably attached at a first point of the bill, and a contact attached at a second point, whereby upon rotation parallel to the bill of said lamp structure to contact said second contact, a powered electrical circuit closes, providing power to a lamp in said lamp structure.

12. A lighted hat, comprising the hat and a lamp apparatus including a lamp supported on a rotating support structure, said rotating support structure attaching to said bill and providing a switching means accomplished by rotation of said rotating structure.

13. An improved combination hat and spot light, the hat having a crown, a bill extending from the crown, a liner circumscribing at least a portion of an edge of the crown, and an adjustable strap operatively associated with the crown for adjusting the hat to various different head sizes, the liner comprising a strip of material having an upper edge, a lower edge, and first and second ends, the lower edge being securely fastened to a bottom edge of the crown with the upper edge laying against an inner surface of the crown, the first and second ends being attached to respective ends of the adjustable strap, the combination including:

a hermetically sealed push button switch mounted to the bill of the hat near an edge thereof;

first and second battery holders each located respectively on opposite sides of the crown of the hat between the crown and the liner;

first and second wires extending from the push button switch and continuing through an opening in one of the crown and the liner, the first wire being connected to one end of the first battery holder and the second wire extending in a direction away from said first wire and terminating in a first wire connector located between the crown and the liner;

a third wire originating from one end of the second battery holder, said wire extending around said crown between the crown and liner and being connected to another end of the first battery holder for effecting a series electrical circuit between said first and second battery holders;

a high intensity lamp having first and second electrical connections for coupling electrical power to the lamp;

first and second wires connected respectively to the first and second electrical connections on said lamp, said wires extending along and being clamped to an upper surface of the bill, said wires extending through an aperture in the crown adjacent the bill, the first wire from the lamp being connected to another end of the second battery holder, the second wire from the lamp being coupled to the second wire from the switch at the first wire connector; a lamp support comprising a relatively stiff support rod having a first end bent so as to be located in a plane parallel to the bill of the hat for attachment thereto, another portion extending in an upwardly angled direction from the first end, and a second end extending substantially normal to a plane defined by the first end and the another portion; and connection means attached to an outer surface of the lamp for receiving the second end of the lamp support, the connection means comprising an outer non-resilient tube bonded to the lamp and an inner resilient tube inserted into the outer tube, the second end of the lamp support being press-fit into the inner tube to establish a pivotable connection between the lamp and the lamp support and having a fit such that the lamp is retained in any angular orientation into which it is manually positioned;

said improvement comprising said lamp supported on a rotating support structure, said rotating support structure attaching to said bill and providing a switching means accomplished by rotation of said rotating structure, thereby replacing said hermetically sealed push button switch and said lamp support.

* * * * *